US005130912A

United States Patent [19]

Friederichs et al.

[11] Patent Number: 5,130,912

[45] Date of Patent: Jul. 14, 1992

[54] ELECTRODELESS LOW-PRESSURE DISCHARGE LAMP

[75] Inventors: Winand H. A. M. Friederichs; Nicasius G. T. Van Gennip, both of Eindhoven, Netherlands

[73] Assignee: U.S. Philips Corporation, New York, N.Y.

[21] Appl. No.: 682,800

[22] Filed: Apr. 8, 1991

[30] Foreign Application Priority Data

Apr. 6, 1990 [NL] Netherlands ..... 9000807

[51] Int. Cl.[5] ..... H01J 61/00

[52] U.S. Cl. ..... 362/263; 313/493

[58] Field of Search ..... 362/263, 264, 265; 313/493; 315/248

[56] References Cited

U.S. PATENT DOCUMENTS

| | | | |
|---|---|---|---|
| 4,119,889 | 10/1978 | Hollister | 313/493 |
| 4,187,447 | 2/1980 | Stout et al. | 313/493 |
| 4,922,157 | 5/1990 | Van Engen et al. | 313/493 |
| 4,927,217 | 5/1990 | Kroes et al. | 313/493 |
| 5,006,752 | 4/1991 | Eggink et al. | 313/493 |

*Primary Examiner*—Richard R. Cole

*Attorney, Agent, or Firm*—Brian J. Wieghaus

[57] ABSTRACT

An electrodeless low-pressure discharge lamp has a tube of synthetic material in a cavity in the discharge vessel, which tube surrounds a core of magnetic material and is itself surrounded by an electric coil. The tube is bipartite, extends to outside the cavity, and has a flange which is fastened to a mounting plate and is coupled to the discharge vessel. A heatpipe extending inside the tube has a second flange clamped between the flange of the tube and the mounting plate.

20 Claims, 2 Drawing Sheets

ELECTRODELESS LOW-PRESSURE DISCHARGE LAMP

BACKGROUND OF THE INVENTION

The invention relates to an electrodeless low-pressure discharge lamp provided with

- a discharge vessel closed in a vacuumtight manner, containing ionizable metal vapour and rare gas, and having a cavity at an end portion thereof;
- an electric coil surrounding a tube of synthetic material inside the cavity of the discharge vessel;
- a core of magnetic material in the tube of synthetic material;
- a mounting plate supporting the discharge vessel and a high-frequency electric supply, which supply is connected to the electric coil.

Such an electrodeless low-pressure discharge lamp is described in the European Patent Application 90.200.339.1 not previously published which corresponds to U.S. Pat. No. 5,006,752. Such a lamp, which contains, for example, mercury or sodium as the ionizable metal vapour, has a very long life as a result of the absence of electrodes, for example of several tens of thousands of hours. This long life means that the lamp must be of a reliable construction. On the other hand, it is desirable for the lamp to be of a construction which can be easily realised.

SUMMARY OF THE INVENTION

According to the invention this object is achieved in that the tube of synthetic material extends to outside the cavity of the discharge vessel, has a flange there which is fastened against the housing, and is coupled to the discharge vessel.

This construction is reliable and simple, and also easy to realise.

It is favourable for the tube to be of a bipartite design, a first part being arranged substantially inside the cavity of the discharge vessel, a second part at least partly outside it. The second part can then be used for enclosing the body of magnetic material, such as, for example, ferrite, for example Philips 4C6, in the first part. It is convenient to connect the second part to the first part by means of a snap connection.

The bipartite design renders it possible to choose for each part a synthetic material whose characteristics are adapted to the function and operating conditions of the part. The thermal resistance is an important characteristic for the fist part present in the cavity, the mechanical resistance for the second part.

It is convenient for lamp assembly if the electric coil is connected to rigid conductors projecting from the flange through openings in the mounting plate. In a favourable embodiment, these conductors are enveloped by sleeves formed at the flange at least up to inside the openings in the mounting plate. The conductors may be moulded-in in the synthetic material of the flange.

In an embodiment, the conductors are each connected to an electric coil by means of a furcate metal plate shaped to act as a piercing contact and which is accommodated in a sheath at the tube, particularly at the second part of the tube.

The electric coil may have a single layer of turns and run from the free end of the tube in the longitudinal direction of the tube to the flange. This means that the coil is locally thicker than elsewhere. It is useful to position the sheath eccentrically in the cavity in order to bring the coil as close as possible to the discharge vessel all round. To this end, the coil may have at last one eccentric rim at the first part. This rim may be accommodated in the cavity with clearance. In a favourable modification, the first part has an eccentric rim near each of its ends.

The first part of the tube may be closed at its free end. Alternatively, this part may be narrowed there in order to keep the core of magnetic material enclosed. An effective narrowing, in a simple embodiment, consists of a local deformation of the tube. This may b easily obtained by thermal means.

In a favourable embodiment, the tube has projections which keep the electric coil positioned around the tube.

The flange of the tube may be coupled to the discharge vessel by means of hooks present at this flange, for example integral with it. These hooks may cooperate with a rim at the discharge vessel. This rim may be integral with the discharge vessel, be formed as part of it. It is advantageous, however, for a greater accuracy of shape and dimensions and a substantially rattle-free coupling, if a rim of synthetic material is fastened to the discharge vessel. This may be realised, for example, with a glue or a cement, such as, for example, silicone paste. The rim of synthetic material may then lie against the flange, while the hooks of the flange grip around it. The discharge vessel may then still be rotatable relative to the flange, unless a blocking device against this has been provided.

If desirable in view of the power consumed by the lamp, a closed tubular container filled with liquid may be accommodated in the core of magnetic material, which container is provided with a flange, the flange being clamped in between the flange of the tube and the mounting plate, for example with bolts. Such a flanged tubular container, made of, for example, copper or another heat conductor, acts as a heat pipe, transferring heat from the core and the first part of the tube to the housing. The liquid, for example alcohol or water, in the container evaporates, removing heat from the core, flows through the flange of the container and condenses. The condensation heat is transmitted to the flange and, via the mounting plate, to the surroundings. If the mounting plate is made of metal at the area of the flange, it is favourable to separate the flange from the mounting plate by means of an insulating material, for example a synthetic foil, to prevent corrosion by processes such as take place in a galvanic cell.

These and other, more detailed aspects of the invention will be described and explained with reference to the drawings.

DESCRIPTION OF THE PREFERRED EMBODIMENTS

Figure 1:
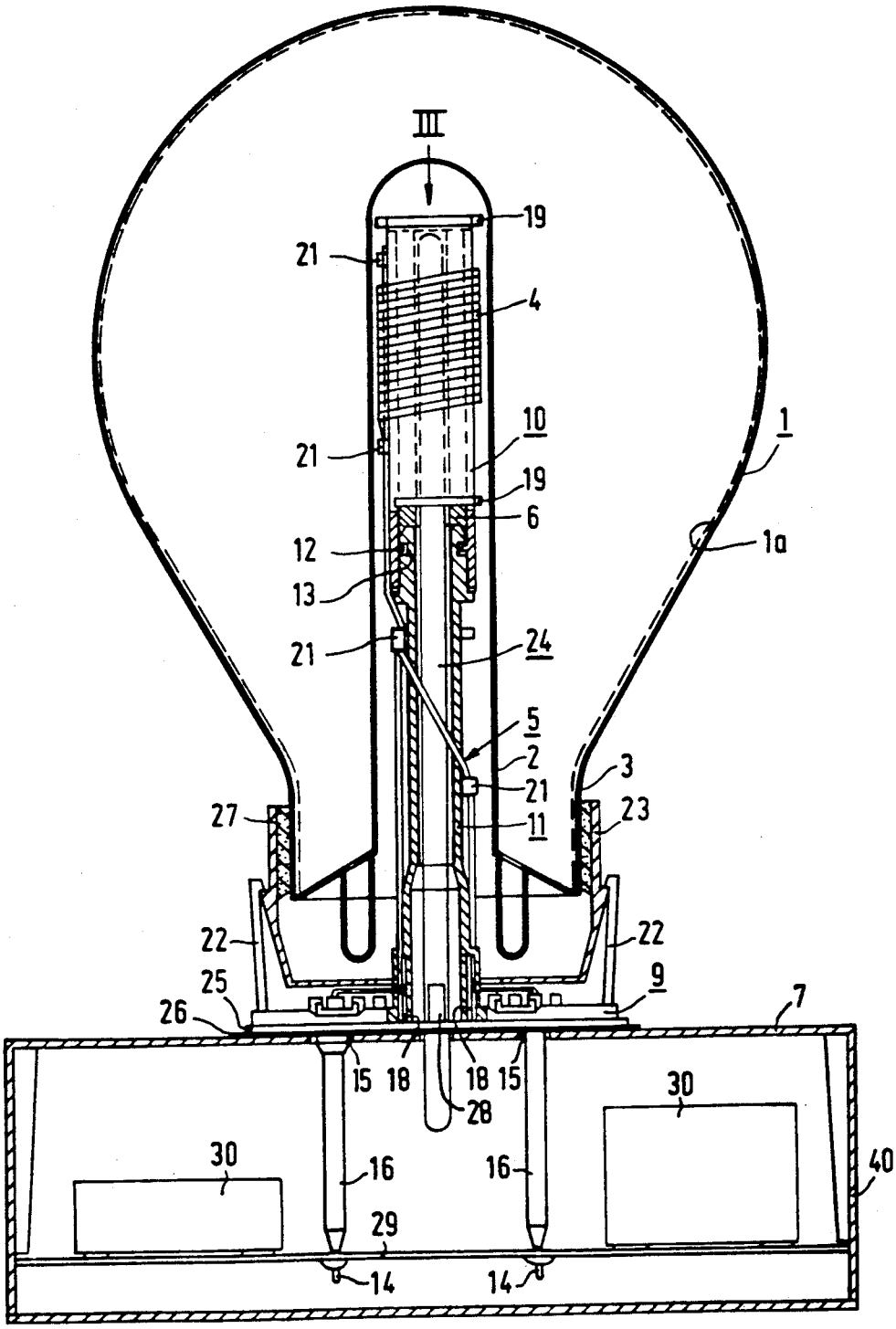
FIG. 1 shows a lamp partly in cross-section, partly in elevation.

The electrodeless low-pressure discharge lamp of FIG. 1 has a discharge vessel 1 which is closed in a vacuumtight manner, contains ionizable metal vapour and rare gas, and has a cavity 2 at an end portion 3 thereof. If mercury is used as the metal vapour, the inner surface of the discharge vessel 1 is coated with fluorescent powder 1a. An electric coil 4 is arranged around a tube 5 of synthetic material which projects into the cavity 2.

A core 6 of magnetic material is inside the tube 5 of synthetic material.

A mounting plate 7 supports the discharge vessel and a high-frequency electric supply 8 which is connected to the electric coil 4.

The tube 5 of synthetic material extends to outside the cavity 2 of the discharge vessel 1 and has a flange 9 outside this cavity 2, which flange is mounted against the mounting plate 7 and coupled to the discharge vessel 1.

The tube 5 is bipartite and has a first part 10 mainly inside the cavity 2 of the discharge vessel 1 and a second part 11 at least partly outside this cavity 2.

The first part 10 and the second part 11 of the tube 5 are coupled together by means of a snap connection 12, 13 formed by a circular ridge 12 at the first part 10 and a circular groove 13 in the second part 11.

The second part 11 encloses the core 6 in the first part 10. The core 6, alternatively, may also rest on a rim in the first part 10. It is also possible to have the core rest on a ring, for example made of synthetic material, which rests on the second part 11. The first part 10 and the second part 11 of the tube 5 may be locked against mutual rotation, for example by a cooperating projection and groove in longitudinal direction of the tube 5.

The electric coil is connected to rigid conductors 14 which project form the flange 9 through openings 15 int he mounting plate 7.

The conductors 14 are enveloped by sleeves 16 formed at the flange 9 at least up to inside the openings 15 in the mounting plate 7. In the Figure, the conductors 14 are moulded-in in the synthetic material of the flange 9.

The first part 10 of the tube 5 has an eccentric rim 19 which is accommodated with clearance in the cavity 2 of the discharge vessel 1. In the Figure, the first part 10 of the tube 5 has an eccentric rim 19 near each of its ends.

Projections 21, which keep the electric coil 4 fixed around the tube 5, form part of this tube.

The flange 9 of the tube 5 is coupled to the discharge vessel 1 by means of hooks 22 present at the flange 9, which hooks in the Figure are integral with the flange 9 and grip around a rim 23 of synthetic material fastened around the end portion 3 of the discharge vessel 1. The rim 23 is attached to the discharge vessel 1 with an adhesive 27, for example silicone resin. The rim 23 is kept pressed against the flange 9, more particularly against a rib 28 at the flange 9, by the hooks 22 so that there is a rattle-free coupling between the discharge vessel 1 and the flange 9.

A closed tubular container 24 made of, for example, copper and holding a liquid, for example water, is accommodated in the core 6 of magnetic material and is provided with a flange 25. The flange 25 made of, for example, copper is held clamped in between the flange 9 of the tube 5 and the mounting plate 7, with a plastic foil 26 of, for example, silicone resin possibly reinforced with glass fibre interposed between them.

The first part 10 and the second part 11 of the tube 5 may be formed from, for example, a thermoplastic synthetic substance, the first part 10, for example, from a liquid crystalline synthetic material, the second part, for example, from polyether imide, polyether sulphon, or polyether sulphide, which may be filled with, for example, glass fibres. The rim 23 may also consist of such material.

The tube 5 carries projections 21 which keep the coil 4 positioned around the tube 5.

The tube 5 carries sheaths 18 in which respective furcate metal plates 19 (see FIG. 2) are accommodated, which plate connect the conductors 14 to the coil 4 acting as piercing contacts.

The mounting plate 7 in the Figure is a wall of a housing 40 in which a support 29 carrying an integrated circuit is present, which connects the conductors 14 to a high-frequency electric supply 30.

The mounting plate 7 may support a reflector for the lamp.

The coil 4 may be of bifilar design, one wire being connected to the supply with both its ends, the other wire only with one end, while the other end is electrically unconnected. Such a bifilar coil suppresses radio interference by the lamp.

Figure 2:
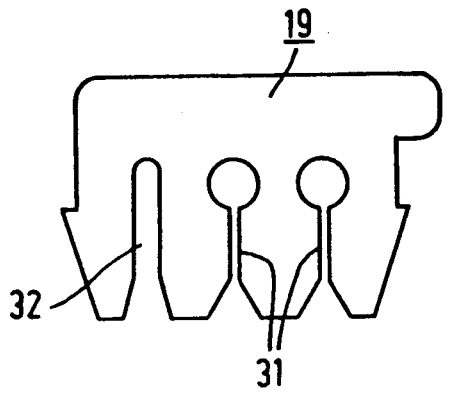
FIG. 2 shows an elevation of a contact plate.

FIG. 2 shows a metal plate 19 which has slots 31 for clamping in one end of the coil in one of them, or in each of the two an end of a bifilar coil. A conductor 14 may be clamped in in the slot 32 in order to connect the coil 4 to the supply 30.

Figure 3:
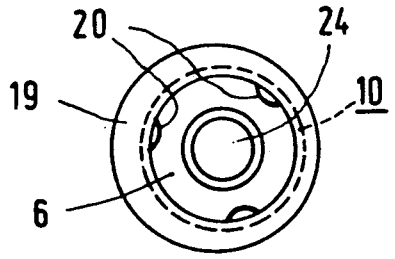
FIG. 3 shows the top view of the coil tube of FIG. 1 according to III.

FIG. 3 shows a narrowing 20 of the tube 5 at its end facing away from the flange 9, that closes in the core 6. The narrowing 20 consists of a number of deformations of the first part 10 of the tube 5 obtained by thermal means.

We claim:

1. An electrodeless low-pressure discharge lamp, comprising a discharge vessel closed in a vacuumtight manner, containing ionizable metal vapour and rare gas, and having a cavity at an end portion thereof, an electric coil and a tube of synthetic material inside said discharge vessel cavity, said coil surrounding said tube, a core of magnetic material in said tube of synthetic material, and a mounting plate supporting said discharge vessel characterized in that;

said tube of synthetic material is bipartite and comprises a first part mainly inside said discharge vessel cavity and a second part which extends to outside said cavity, said first and second tube parts being comprised of different materials and being mechanically joined together, said second part having an integral flange outside said cavity which is fastened against said mounting plate and is coupled to said discharge vessel.

2. An electrodeless low-pressure discharge lamp as claimed in claim 1, characterized in that said first and second tube parts are coupled together by means of a snap connection.

3. An electrodeless low-pressure discharge lamp as claimed in claim 2, characterized in that said electric coil is connected to rigid conductors projecting from said flange through openings in said mounting plate.

4. An electrodeless low-pressure discharge lamp as claimed in claim 2, characterized in that said first tube part has an eccentric rim which is accommodated with clearance in said discharge vessel cavity for eccentrically positioning said coil in said cavity.

5. An electrodeless low-pressure discharge lamp as claimed in claim 2, characterized in that said second part fixes said core of magnetic material in said first part.

6. An electrodeless low-pressure discharge lamp as claimed in claim 5, characterized in that said tube has a narrowing at its end facing away from said flange, narrowing keeps said core closed in.

7. An electrodeless low-pressure discharge lamp as claimed in claim 1, characterized in that said electric coil is connected to rigid conductors projecting from said flange through openings in said mounting plate.

8. An electrodeless low-pressure discharge lamp as claimed in claim 7, characterized in that said flange comprises sleeves which envelope respective ones of said rigid conductors at least up to inside the openings in said mounting plate.

9. An electrodeless low-pressure discharge lamp as claimed in claim 8, characterized in that said rigid conductors are moulded in the synthetic material of said flange.

10. An electrodeless low-pressure discharge lamp as claimed in claim 7, characterized in that said second tube part comprises a furcate metal plate for piercingly contacting a said rigid conductor, said furcate plate being fixed in a sheath of said second tube part and connected to said electric coil.

11. An electrodeless low-pressure discharge lamp as claimed in claim 1, characterized in that said first part of the tube has an eccentric rim which is accommodated with clearance in said cavity (2) of said discharge vessel.

12. An electrodeless low-pressure discharge lamp as claimed in claim 11, characterized in that said first part has an eccentric rim near each of its ends for eccentrically positioning said coil in said cavity.

13. An electrodeless low-pressure discharge lamp as claimed in claim 1, characterized in that said tube has a narrowing at its end facing away from said flange, which keeps said core closed in.

14. An electrodeless low-pressure discharge lamp as claimed in claim 1, characterized in that said tube has projections which axially positive said electric coil on said tube.

15. An electrodeless low-pressure discharge lamp as claimed in claim 1, characterized in that said tube comprises hooks for coupling said flange to said discharge vessel.

16. An electrodeless low-pressure discharge lamp as claimed in claim 15, characterized in that said hooks are integral with the flange.

17. An electrodeless low-pressure discharge lamp as claimed in claim 1, characterized in that a rim of synthetic material is fastened around the end portion of said discharge vessel.

18. An electrodeless low-pressure discharge lamp as claimed in claim 17, characterized in that said hooks at said tube flange grip around said rim of synthetic material and keep said rim pressed against said flange.

19. An electrodeless low-pressure discharge lamp as claimed in claim 1, characterized in that a closed tubular container filled with liquid is accommodated in said core of magnetic material, said container having a flange which is kept clamped-in between said tube flange and said mounting plate.

20. An electrodeless low-pressure discharge lamp as claimed in claim 19, characterized in that a foil of synthetic material is present between said flange of said tubular container and said mounting plate.

* * * * *